United States Patent [19]

Fergusson

[11] 4,312,129

[45] Jan. 26, 1982

[54] CUTTING DEVICE FOR USE IN KITE FIGHTING

[76] Inventor: John D. Fergusson, 711 Yale Ave., Terrace Park, Ohio 45174

[21] Appl. No.: 114,504

[22] Filed: Jan. 23, 1980

[51] Int. Cl.[3] ..... B26B 27/00

[52] U.S. Cl. ..... 30/296 R; 30/303; 46/77; 244/155 R

[58] Field of Search ..... 30/296 R, 296 A, 317, 30/351, 355, 356, 303, 346.56; 244/155; 46/77 R

[56] References Cited

U.S. PATENT DOCUMENTS

| | | | |
|---|---|---|---|
| 766,558 | 8/1904 | Wagner | 30/303 |
| 847,321 | 3/1907 | Date et al. | 30/317 |
| 1,377,805 | 5/1921 | Clear | 30/296 R |
| 1,532,413 | 4/1925 | Kita | 30/296 A |
| 1,579,577 | 4/1926 | Thompson | 30/346.56 |
| 1,581,310 | 4/1926 | Fetschan | 30/303 |
| 1,961,132 | 6/1934 | Behrman | 30/346.56 |
| 2,043,998 | 6/1936 | Hadjopoulos | 30/346.56 |
| 2,314,528 | 3/1943 | Temple | 30/296 R |
| 3,233,643 | 2/1966 | Reuterfors | 30/317 |
| 3,358,399 | 12/1967 | Waldmann | 43/18 R |
| 3,806,073 | 4/1974 | Christie | 244/155 R |

FOREIGN PATENT DOCUMENTS

| | | | |
|---|---|---|---|
| 288086 | 5/1953 | Switzerland | 30/317 |
| 234347 | 5/1925 | United Kingdom | 30/296 R |
| 602414 | 5/1948 | United Kingdom | 30/303 |

OTHER PUBLICATIONS

"Fly-Line Retriever Works Like a Tree Trimmer", Popular Mechanics, Jun. 1946, p. 199.

*Primary Examiner*—Stephen G. Kunin
*Assistant Examiner*—J. T. Zatarga
*Attorney, Agent, or Firm*—Wood, Herron & Evans

[57] ABSTRACT

A cutting device comprising one or more cutting elements is configured for connection to a kite string for use in a game of kite fighting. Each of the cutting elements has at least one blade for snagging and cutting an opposing player's kite string. Each blade is formed inwardly from the periphery of the cutting element so that the blades are recessed for eliminating the risk of contact with the blades during connection of the cutting device to the kite string or if the cutting device strikes a player or spectator during a game of kite fighting, thereby avoiding the chance of injury. Preferably, the cutting elements have cooperating slots for interfitting the cutting elements together. Eyelets are preferably formed integrally with each of the cutting elements for connecting the cutting device to a kite string by threading the kite string through the eyelets and tying knots. The cutting elements are preferably constructed from soft metal so that the cutting device crushes flat if inadvertently stepped on while on the ground. Other features, such as the use of a spinner combined with the cutting device for allowing rotation of the kite, are also provided.

4 Claims, 3 Drawing Figures

CUTTING DEVICE FOR USE IN KITE FIGHTING

BACKGROUND OF THE INVENTION

This invention relates to the amusement activity of kite flying and, more particularly, to a game involving the use of kites known as kite fighting. Specifically, the invention is directed to equipment needed for a game of kite fighting and in particular to a cutting device for use in kite fighting.

Kite fighting is a game played by two or more players. Each player has a kite with a cutting means applied or attached to the string of the kite.

The field of play is first agreed upon. Each player then sends his kite aloft and moves within the field of play to maneuver his kite with the objective of cutting the other player's kite string before his kite string is cut.

Previously, makeshift cutting means has been used in kite fighting. Known cutting means is quite difficult to apply or attach to the kite string and is dangerous to use. In the past, for example, the kite string has been covered with wax and glass particles embedded in the wax to serve as a cutting means or a razor blade has been attached to the kite string to serve as a cutter. As the cutting means is applied or attached to the kite string or falls to the ground during a game of kite fighting after a player's kite string is cut, there is a risk of injury to players and spectators.

The primary objective of the invention is to provide an effective and safe cutting device for use in kite fighting.

Another objective is to provide a cutting device for snagging and cutting at opposing player's kite string during a game of kite fighting which is easily connected to a kite string.

A further objective is to provide a cutting device which can be easily connected to a kite string by a player without risk of injury prior to a game of kite fighting.

An additional objective is to provide a cutting device having guarded cutting means designed specifically for use in kite fighting for eliminating the risk of injury if the cutting device strikes a player or spectator during a game of kite fighting.

Yet another objective is to provide an economical cutting means for use in kite fighting.

SUMMARY OF THE INVENTION

The above and other objectives are achieved in accordance with a preferred embodiment of the invention which provides a safe cutting device for use in kite fighting. The cutting device comprises one or more cutting elements configured for connection to a kite string. Each cutting element has at least one blade for snagging and cutting an opposing player's kite string. Each blade is formed inwardly from the periphery of the cutting element so that the blades are recessed for eliminating the risk of contact with the blades during connection of the cutting device to the kite string or if the cutting device contacts a player or spectator during a game of kite fighting, thereby avoiding the chance of injury. Preferably, the cutting elements have cooperating slots for interfitting the cutting elements together. Eyelets are preferably formed integrally with each of the cutting elements for connecting the cutting device to a kite string by threading the kite string through the eyelets and tying knots. The cutting elements are preferably constructed from soft metal so that the cutting device crushes flat if inadvertently stepped on while on the ground. The cutting device may be combined with a spinner for allowing rotation of the kite as the kite is maneuvered by a player during a game of kite fighting.

The cutting device of the invention is more efficient for snagging and cutting an opposing player's kite string than previously known cutting means such as glass particles embedded in wax applied to the kite string or razor blades attached to the kite string. Furthermore, the cutting device of the invention eliminates the dangers attendant with the use of previously used cutting means.

BRIEF DESCRIPTION OF THE DRAWING

The above and other features of the invention and the concomitant advantages will become more clear to those of skill in the art after a consideration of the following description. In order to facilitate an understanding of the invention, the description will be given in connection with the attached drawing in which.

DESCRIPTION

Figure 1:
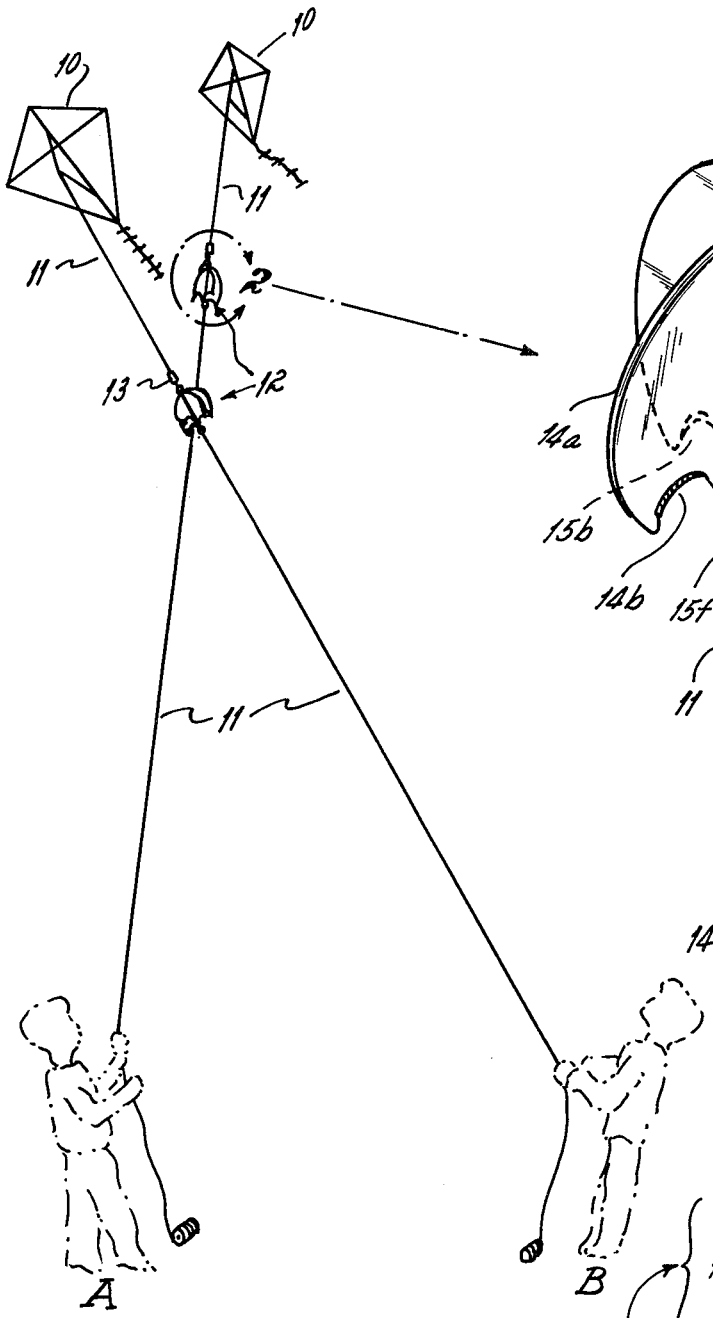
FIG. 1 is a view of two players engaged in a kite fighting game using the cutting device of the invention.

FIG. 1 shows two players A and B engaged in a game of kite fighting. Each player has a kite 10. The kites are preferably Indian fighting kites which are recommended because of their agile and responsive maneuvering characteristics. However, the type of kite used has no relation to the invention.

In a conventional fashion, a kite string 11 is connected to each kite 10 for maneuvering the kite. The kite string for each kite should be basically the same thickness and quality.

In accordance with the invention, a cutting device 12 is connected to each kite string 11 at a selected position. A spinner 13 is preferably connected between each cutting device 12 and the length of string connected to each kite. Each spinner 13 may be a conventional fishing line spinner and is recommended for allowing complete rotation of the kite as the kite is maneuvered.

Figure 3:
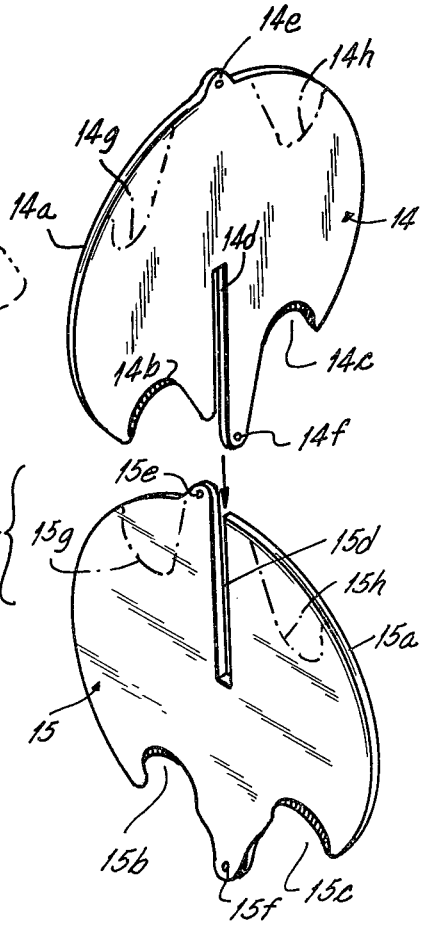
FIG. 3 is an exploded view of a preferred embodiment of the cutting device of the invention.

A preferred form for the cutting device of the invention is shown in exploded view in FIG. 3. Cutting device 12 preferably includes two cutting elements including a first cutting element 14 and a second cutting element 15.

Cutting element 14 has a periphery **14*a* which is recessed at 14*b* and 14*c*, and the inwardly lying portions of recesses 14*b* and 14*c* are ground forming sharpened blades. Except for recessed blades 14*b* and 14*c*, periphery 14*a* of cutting element 14** is beveled, or rounded, so that there are no exposed sharp edges to cut a player or spectator.

Similarly, cutting element 15 has a periphery **15*a* which is recessed at 15*b* and 15*c*, and the inwardly lying portions of recesses 15*b* and 15*c* are ground forming sharpened blades. Except for the recessed blades 15*b* and 15*c*, periphery 15*a* of cutting element 15** is also beveled so that there is no chance of injury to a player or spectator.

In a modified form of the cutting device of the invention, blades may be provided in the lower portion of each cutting element 14, 15 as already described and/or in the top portion of each cutting element. Specifically, as shown in phantom lines in FIG. 3, periphery 14*a* of cutting element 14 may be recessed and ground formed blades 14*g* and 14*h*. Also, periphery 15*a* of cutting element 15 may be recessed and ground forming blades 15*g* and 15*h*.

Cutting element 14 also has a slot 14*d* extending inwardly from the bottom of the cutting element, that is, from the periphery of the cutting element between blades 14*b* and 14*c*, to the center of the cutting element. Cutting element 15, on the other hand, has a slot 15*d* extending inwardly from the top of the cutting element, that is, from the periphery of the cutting element opposite blades 15*b* and 15*c*, to the center of the cutting element. In order to assemble cutting device 12, slot 14*d* is merely interfitted with slot 15*d* as shown by the arrow in FIG. 3.

Also, an upper eyelet 14*e* is formed in periphery 14*a* at the top of cutting element 14, and a lower eyelet 14*f* is formed in the periphery at the bottom of the cutting element. Similarly, an upper eyelet 15*e* is formed in periphery 15*a* at the top of cutting element 15, and a lower eyelet 15*f* is formed in the periphery at the bottom of the cutting element.

Figure 2:
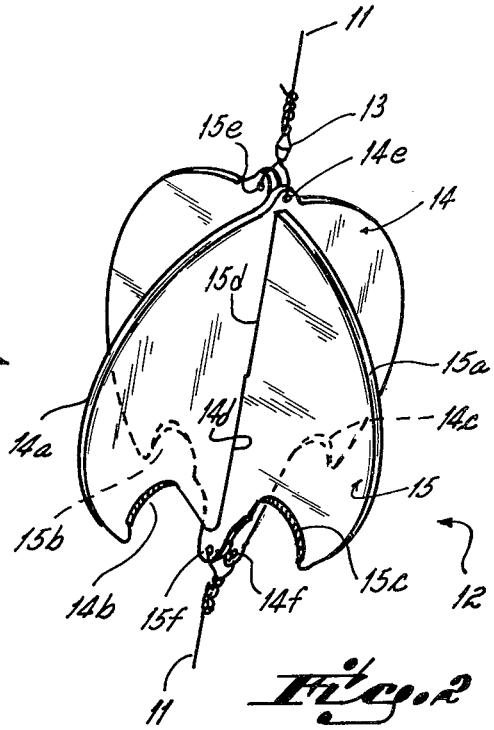
FIG. 2 is a detail of the cutting device shown in FIG. 1 illustrating connection of the cutting device to a kite string.

After cutting device 12 is assembled by interfitting cooperating slot 14*d* of cutting element 14 and slot 15*d* of cutting element 15 as shown in FIG. 3, the cutting device is ready to connect to the kite string. As shown in FIG. 2, after cutting elements 14 and 15 are assembled, upper eyelets 14*e* and 15*e* are juxtaposed, and lower eyelets 14*f* and 15*f* are also juxtaposed. Preferably, a conventional fishing line spinner 13 is connected at one end to upper eyelets 14*e* and 15*e* and at the other end to the length of kite string 11 which extends to kite 10. As shown in FIG. 2, the length of kite string 11 which is held by a player is threaded through lower eyelets 14*f* and 15*f* and tied.

Once a cutting device 12 is connected to each kite string 11, players A and B send their kites aloft. Thereafter, each player tries to maneuver his kite so as to bring the cutting device connected to his kite string into position where he can snag and cut the opposing player's kite string. If only blades 14*b*, 14*c*, 15*b*, and 15*c* are provided, a player must maneuver his kite to position his cutting device above his opponent's kite string and pull his kite string downwardly in order to snag and cut his opponent's kite string. If blades 14*g*, 14*h*, 15*g*, and 15*h* are provided, a player can snag and cut an opposing player's kite string by maneuvering his kite to position his cutting device below his opponent's kite string and letting out his kite string.

Cutting elements 14 and 15 are preferably die cut from soft metal. Consequently, after a player's kite string is cut and the cutting device falls to the ground, the cutting device will crush flat if stepped on avoiding injury to players and spectators.

As can now be appreciated, the invention provides an efficient and safe cutting device for use in kite fighting. Various modifications have been described and further modifications may appear to those of skill in the field without departing from the spirit of the invention. In order to ascertain the true scope of the invention, reference should therefore be had to the appended claims.

Accordingly, I claim:

1. A kite fighting device comprising, a kite, a string connected to said kite and a string cutter connected between upper and lower portions of said string, said string cutter comprising, a pair of crossed planar cutting elements having arcuate outer edges and intersecting each other at approximately right angles, means connecting said string cutter at the upper and lower ends of the intersection of said cutting elements to the upper and lower portions of said kite string, respectively, each said cutting element having a recess in one of the upper and lower edges thereof on each side of said intersection for trapping a string within the recess, a portion of each recess inward of the outer edge of said cutting element having a sharpened edge with the outboard portion of said recess being unsharpened, whereby in flying said kite across the string of an adjacent kite, said recess can be hooked on the adjacent string to cut the same.

2. A kite fighting device as in claim 1 in which said connecting means consists of swiveling spinners connected between said string and said string cutter.

3. A kite fighting device as in claim 1 further comprising, means forming said recesses in the upper and lower edges of each cutting element on each side of said intersection.

4. A kite fighting device as in claim 1 wherein said cutting elements have interfitting, vertical slots permitting said string cutter to be assembled by sliding each element into the slot of the other element, and eyelets at each end of each element.

* * * * *